US012678846B2

(12) United States Patent
Sano et al.

(10) Patent No.: US 12,678,846 B2
(45) Date of Patent: Jul. 14, 2026

(54) PLATE CROWN CONTROL DEVICE

(71) Applicant: TMEIC CORPORATION, Tokyo (JP)

(72) Inventors: Mitsuhiko Sano, Tokyo (JP); Atsushi Suzuki, Tokyo (JP)

(73) Assignee: TMEIC CORPORATION, Tokyo (JP)

( * ) Notice: Subject to any disclaimer, the term of this patent is extended or adjusted under 35 U.S.C. 154(b) by 220 days.

(21) Appl. No.: 18/561,311

(22) PCT Filed: Apr. 20, 2022

(86) PCT No.: PCT/JP2022/018313
§ 371 (c)(1),
(2) Date: Nov. 16, 2023

(87) PCT Pub. No.: WO2023/203691
PCT Pub. Date: Oct. 26, 2023

(65) Prior Publication Data
US 2024/0226978 A1 Jul. 11, 2024

(51) Int. Cl.
*B21B 37/38* (2006.01)
*B21B 37/16* (2006.01)
*B21B 37/28* (2006.01)

(52) U.S. Cl.
CPC ..... *B21B 37/38* (2013.01); *B21B 37/165* (2013.01)

(58) Field of Classification Search
CPC ..... B21B 37/38; B21B 37/165; B21B 37/28
See application file for complete search history.

(56) References Cited

FOREIGN PATENT DOCUMENTS

| | | | |
|---|---|---|---|
| JP | S59-215205 | A | 12/1984 |
| JP | H03-72364 | A | 3/1991 |
| JP | H04-367901 | A | 12/1992 |
| JP | H06-254611 | A | 9/1994 |
| JP | H09-234506 | A | 9/1997 |
| JP | H11-104721 | A | 4/1999 |
| JP | 3253013 | B2 | 2/2002 |
| JP | 2004-255436 | A | 9/2004 |
| JP | 2004-337895 | A | 12/2004 |

(Continued)

OTHER PUBLICATIONS

English translate (JP2019063811A), retrieved date Oct. 19, 2025.*

(Continued)

*Primary Examiner* — Mohammed S. Alawadi
(74) *Attorney, Agent, or Firm* — XSENSUS LLP

(57) ABSTRACT

A plate crown control device controls tandem rolling equipment based on delivery-side plate crown setting calculation values of stands calculated by setting calculation, mechanical plate crown setting calculation values of the stands, and setting values of bending forces and shift positions of the stands. A processor calculates first learning current values based on differences between mechanical plate crown observation values and mechanical plate crown actual calculation values. The processor prorates first learning values with first learning current values and smoothing gains and updates the first learning values. The processor calculates, in the setting calculation for the next and subsequent materials, setting values of bending forces and shift positions of the stands using mechanical plate crown setting calculation values after correction obtained by adding the first learning values to the mechanical plate crown setting calculation values.

6 Claims, 9 Drawing Sheets

(56) References Cited

FOREIGN PATENT DOCUMENTS

| | | | | |
|---|---|---|---|---|
| JP | 2019055415 | A | * | 4/2019 |
| JP | 2019063811 | A | * | 4/2019 |
| JP | 6848844 | B2 | * | 3/2021 |
| WO | 2015/122010 | A1 | | 8/2015 |

OTHER PUBLICATIONS

English translate (JP2019055415A), retrieved date Oct. 19, 2025.*
English translate (JP6848844B2), retrieved date Oct. 19, 2025.*
International Search Report and Written Opinion mailed on Jul. 12, 2022, received for PCT Application PCT/JP2022/018313, filed on Apr. 20, 2022, 11 pages including English Translation.
Yanagi et al., "Development of Set Up Model of Crown Control for Aluminum Hot Finishing Mill", Kobe Steel Engineering Reports, vol. 58, No. 3, Dec. 2008, pp. 29-34 (6 pages including English Abstract).
Shohet et al., "Roll Bending Methods of Crown Control in Four-High Plate Mills", Journal of The Iron and Steel Institute, Nov. 1968, pp. 1088-1098.
Shohet et al., "Flatness Control in Plate Rolling", Journal of The Iron and Steel Institute, Oct. 1971, pp. 769-775.
Office Action issued Jan. 15, 2026 in Chinese Patent Application No. 202280035012.0 with machineEnglish translation.

* cited by examiner

PLATE CROWN CONTROL DEVICE

CROSS-REFERENCE TO RELATED APPLICATION

This application is based on PCT filing PCT/JP2022/018313, filed Apr. 20, 2022, the entire contents of which are incorporated herein by reference

FIELD

The present invention relates to a plate crown control device and, more particularly, to a method of learning and controlling a plate crown control device in hot rolling.

BACKGROUND

A demand for plate thickness accuracy in a plate width direction of a material to be rolled has been becoming stricter year after year. In rolling operation in which a prediction model of a plate crown is used, it has been becoming extremely important to improve accuracy of such a prediction model.

It has been known to use a mechanism such as a work roll bender or a CVC (Continuous Variable Crown) roll shift in order to control the plate crown in this way.

It is necessary to properly set mechanisms of stands in order to enable highly accurate plate crown control. Setting values of these mechanisms are calculated by a plate crown control device. There have been proposed various plate crown prediction methods and setting value calculation methods to achieve the accuracy improvement.

Note that the applicant recognizes the Literatures described below as literatures relating to the present invention.

CITATION LIST

Patent Literature

[PTL 1] Japanese Patent No. 3253013
[PTL 2] JP H3-72364 B
[PTL 3] JP S59-215205 A

Non Patent Literature

[NPL 1] Shusuke Yanagi, Masanori Ikeda, Hiroshi Kunii "Development of Set Up Model of Crown Control for Aluminum Hot Finishing Mill" Kobe Steel Engineering Reports/Vo. 58 No. 3 (December 2008) p 29
[NPL 2] K. N. Shohet, N. A. Townsend "Roll bending methods of crown control in four-high plate mills", J. The Iron and Steel Institute, (November 1968) p 1088
[NPL 3] K. N. Shohet, N. A. Townsend "Flatness control in plate rolling", J. The Iron and Steel Institute, (October 1971) p 769

SUMMARY

Technical Problem

In recent years, a plate crown meter that measures a width direction plate thickness distribution of a material to be rolled and a flatness meter that measures a plate shape have been introduced on a rolling mill delivery side. Dynamic feedback control and the like making use of these meters have been adopted to perform manufacturing of a high-quality material to be rolled.

However, the dynamic feedback control by the plate crown meter and the flatness meter cannot be applied to a most distal end portion of the material to be rolled. Therefore, a plate crown of a product at the most distal end portion depends on setting accuracy of mechanisms of stands by the plate crown control device at a rolling start time.

Therefore, setting accuracy improvement of the mechanisms of stands by the plate crown control device is achieved by learning using the plate crown meter and the flatness meter. A widely-used learning method is a method of correcting an internal target value in setting calculation for the next material based on a measurement value of the plate crown meter.

For example, when a plate crown measurement value is larger by 10 microns with respect to a target value of 40 microns, in the setting calculation for the next material, calculation is performed using, as the internal target value, 30 microns obtained by subtracting 10 microns from the target value.

However, in this method, calculation is performed for a target further different from an original target in a stand further on a rear stage side. Therefore, there is a problem in that errors of various prediction models increases and accuracy improvement is limited.

In PTL 1, correction of a model error is performed by distributing a deviation between a crown actual value measured on a finisher delivery side and a prediction value to mechanical plate crown prediction values of the stands.

However, the crown actual prediction error on the finisher delivery side is simply equally divided by the stands or distributed according to plate thickness ratios. Therefore, when a learning result is reflected on the setting calculation, there is likelihood of causing a problem in that flatness on a delivery side of the stands is deteriorated and a problem in that, for example, bending forces and shift positions of the stands reach mechanical and operational limit values and a target plate crown cannot be achieved.

NPL 1 discloses a method of correcting influence coefficients of a mechanical plate crown model assuming that an actual value of a bender after correction by an operator is positive. This method is based on the premise that roll wear hardly occurs like in aluminum hot rolling and behavior of thermal expansion (thermal crown) of rolls is stable and can be predicted with a slight error. Correction of an estimation error of a roll profile is not considered at all.

However, in steel rolling, since a rolling temperature is high and various alloy components are included, roll wear generally reaches several hundred microns. Since various alloys having different rolling temperatures are rolled in order of mixing, the thermal crown shows complicated behavior. Therefore, even if parameter adjustment is performed by, for example, measurement of a roll temperature, it is difficult to sufficiently reduce the prediction error. Therefore, even if the method by NPL 1 is applied to the steel rolling, there is a problem in that an influence coefficient cannot be corrected at sufficient accuracy because of the influence of the estimation error of the roll profile.

In the methods disclosed in PTL 2 and PTL 3, eventually, a plate crown error detected by the plate crown meter is distributed to the stands by a distribution method determined by only a heredity coefficient or a shape change coefficient and learned. That is, in this distribution, for example, a difference in mechanical crown variable abilities of the stands due to presence or absence of a CVC or a pair cross mechanism is not considered at all. Therefore, although a margin for inter-stand flatness is maximized, there is a problem in that an upper limit or a lower limit of the mechanical crown is reached in a stand having a small mechanical crown variable ability and flatness among the stands and a final stand delivery-side crown cannot be achieved.

The present invention has been made in order to solve the problems described above and an object of the present invention is to provide a plate crown control device that can improve setting accuracy of work roll bending, curve roll shift, and the like and realize stable plate leaping and improvement of a yield.

Solution to Problem

A first aspect relates to a plate crown control device applied to tandem rolling equipment.

The tandem rolling equipment continuously rolls a material to be rolled with a plurality of stands.

The plate crown control device controls the tandem rolling equipment based on delivery-side plate crown setting calculation values of the stands calculated by setting calculation, mechanical plate crown setting calculation values of the stands, and setting values of bending forces and shift positions of the stands.

The plate crown control device includes at least one processor and at least one memory.

The memory stores a delivery-side plate crown measurement value and a flatness measurement value measured, for a measurement point set in a longitudinal direction of the material to be rolled, by a plate crown meter and a flatness meter installed on a delivery side of a last stand among the plurality of stands.

The memory stores actual values including roll forces, bending forces, and shift positions at a time when the measurement point passes the stands.

The memory stores a learning table that stores first learning values of the stands.

The processor is configured to execute the setting calculation, actual value calculation, observation value calculation, first learning value calculation, first learning, and setting calculation value correction.

The actual value calculation calculates mechanical plate crown actual calculation values of the stands based on the measurement values and the actual values.

The observation value calculation calculates, using first learning weight coefficients of the stands, mechanical plate crown observation values of the stands to coincide with the delivery-side plate crown measurement value of the last stand.

The first learning value calculation calculates first learning current values of the stands based on differences between the mechanical plate crown observation values of the stands and the mechanical plate crown actual calculation values of the stands.

The first learning prorates, with the first learning current values and smoothing gains of the stands, the first learning values of the stands stored in the learning table and updates the first learning values.

The setting calculation value correction calculates, in the setting calculation for a next and subsequent materials, setting values of bending forces and shift positions of the stands using mechanical plate crown setting calculation values after correction of the stands obtained by adding the first learning values of the stands read from the learning table to the mechanical plate crown setting calculation values of the stands.

A second aspect further includes the following characteristics in addition to the first aspect.

The learning table stores second learning values of the stands.

The actual calculation value calculation includes calculating delivery-side plate crown actual calculation values of the stands based on the measurement values and the actual values.

The processor is configured to further execute second learning value calculation and second learning.

The second learning value calculation calculates second learning current values of the stands using a difference between the delivery-side plate crown actual calculation value of the last stand and the delivery-side plate crown setting calculation value of the last stand, second learning weight coefficients of the stands, and transfer ratios of the stands.

The second learning prorates, with the second learning current values and the smoothing gains of the stands, the second learning values of the stands stored in the learning table and updates the second learning values.

The setting calculation value correction calculates, in the setting calculation for the next and subsequent materials, setting values of bending forces and shift positions of the stands using mechanical plate crown setting calculation values after correction of the stands obtained by adding the first learning values of the stands and the second learning values of the stands read from the learning table to the mechanical plate crown setting calculation values of the stands.

A third aspect further includes the following characteristics in addition to the first or second aspect.

The actual calculation value calculation includes calculating delivery-side plate crown actual calculation values of the stands based on the measurement values and the actual values.

The observation value calculation multiplies a deviation between the delivery-side plate crown measurement value of the last stand and the delivery-side plate crown actual calculation value of the last stand by the first learning weight coefficients and plate thickness ratios of the stands, adds the delivery-side plate crown actual calculation values of the stands, and calculates delivery-side plate crown observation values of the stands.

The observation value calculation calculates the mechanical plate crown observation values of the stands using entry-side plate crown observation values of the stands and the delivery-side plate crown observation values of the stands, heredity coefficients, transfer ratios, and ratios of plate thickness on an entry side and a delivery side of the stands.

A fourth aspect further includes the following characteristics in addition to the first or second aspect.

The observation value calculation sets constraint conditions, design variables, and an objective function and calculates the design variables to minimize the objective function.

The constraint conditions are plate crown prediction formulas of the stands.

The design variables are the mechanical plate crown observation values of the stands and delivery-side plate crown observation values of the stands excluding the last stand.

The objective function is a total or a square sum of deviations between the mechanical plate crown observation values of the stands and the mechanical plate crown actual calculation values of the stands or absolute values of values obtained by multiplying the deviations by the first learning weight coefficients of the stands.

A fifth aspect further includes the following characteristics in addition to the third or fourth aspect.

The observation value calculation calculates mechanical plate crown variable ranges of the stands from upper limit values and lower limit values of bending forces and shift positions of the stands.

The observation value calculation multiplies the mechanical plate crown variable ranges of the stands by transfer ratios and divides the multiplied mechanical plate crown variable ranges by stand delivery-side plate thicknesses to calculate first plate crown ratio variable ranges of the stands.

The observation value calculation calculates second plate crown ratio variable ranges of the stands based on flatness limits of the stands.

The observation value calculation multiplies smaller of the first plate crown ratio variable ranges and the second plate crown ratio variable ranges of the stands by correction coefficients to calculate the first learning weight coefficients of the stands.

A sixth aspect further includes the following characteristics in addition to the fourth aspect.

The design variables include plate crown ratio heredity coefficients or transfer ratios of the stands.

The constraint conditions include an inequality indicating that the plate crown ratio heredity coefficients are larger in a post-stage stand than a pre-stage stand or the transfer ratios are smaller in the post-stage stand than the pre-stage stand.

A seventh aspect further includes the following characteristics in addition to the second aspect.

The second learning weight coefficients of the stands are values obtained by dividing differences between the mechanical plate crown actual calculation values of the stands and the mechanical plate crown setting calculation values of the stands by delivery-side plate thicknesses of the stands.

Advantageous Effects of Invention

According to the present invention, it is possible to estimate a mechanical plate crown observation value based on a measurement value measured by the plate crown meter disposed on the delivery side of the tandem rolling equipment and learn a difference between the mechanical plate crown observation value and a mechanical plate crown actual calculation value. It is possible to correct a mechanical plate crown prediction value (a design calculation value) in setting calculation for the next and subsequent materials using a result of the learning. Consequently, it is possible to suppress occurrence of a problem in that flatness of the delivery side of the stands is deteriorated and a problem in that vending forces and shift positions of stands reach mechanical and operational limit values and a target plate crown cannot be achieved. As a result, it is possible to improve setting accuracy of work roll bending, curve roll shift, and the like, bring a last stand delivery-side plate crown close to a target value, and realize stable plate leaping and improvement of a yield.

DESCRIPTION OF EMBODIMENTS

Figure 1:
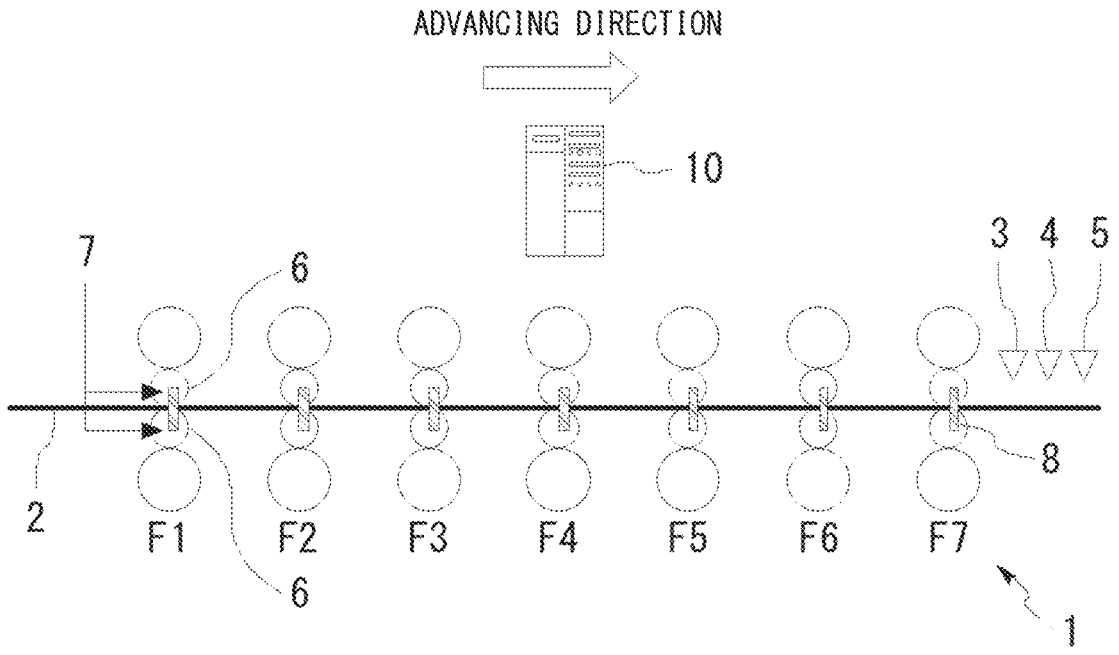
FIG. 1 is a diagram for explaining a configuration example of rolling equipment according to an embodiment of the present invention.

An embodiment of the present invention is explained in detail below with reference to the drawings. Note that elements common to the drawings are denoted by the same reference numerals and signs and redundant explanation of the elements is omitted.

Embodiment

1. Overview of Rolling Equipment

FIG. 1 is a diagram for explaining a configuration example of rolling equipment according to an embodiment of the present invention. Rolling equipment 1 is tandem rolling equipment that continuously rolls a material to be rolled 2 with N (N is a natural number equal to or larger than two) stands. The rolling equipment 1 is, as an example, a finishing mill group including seven (N=7) stands (rolling stands). Stand numbers are F1 to F7. The rolling equipment 1 is disposed on a hot rolling line.

A plate thickness meter 3 by an X ray, a plate crown meter 4 (a profile meter) by an X ray, and an optical flatness meter 5 are installed on a delivery side of a last stand (an N-th stand). Note that, since these measuring instruments are large and expensive, only one measuring instrument is often installed on the delivery side of the last stand.

However, even if entry-side plate thicknesses and delivery-side plate thicknesses of the stands (an i-th stand (i=1, . . . , N)) cannot be measured by the plate thickness meter 3, it is possible to relatively accurately estimate the entry-side plate thicknesses and the delivery-side plate thicknesses using a gauge meter scheme based on roll gaps, roll forces, and mill rigidity in the stands and a mass flow scheme that makes use of the fact that volume velocities among the stands are the same. Since the plate thicknesses are controlled to coincide with predetermined target values by plate thickness control using these schemes, the plate thicknesses are treated as being known in the present invention.

Figure 2:
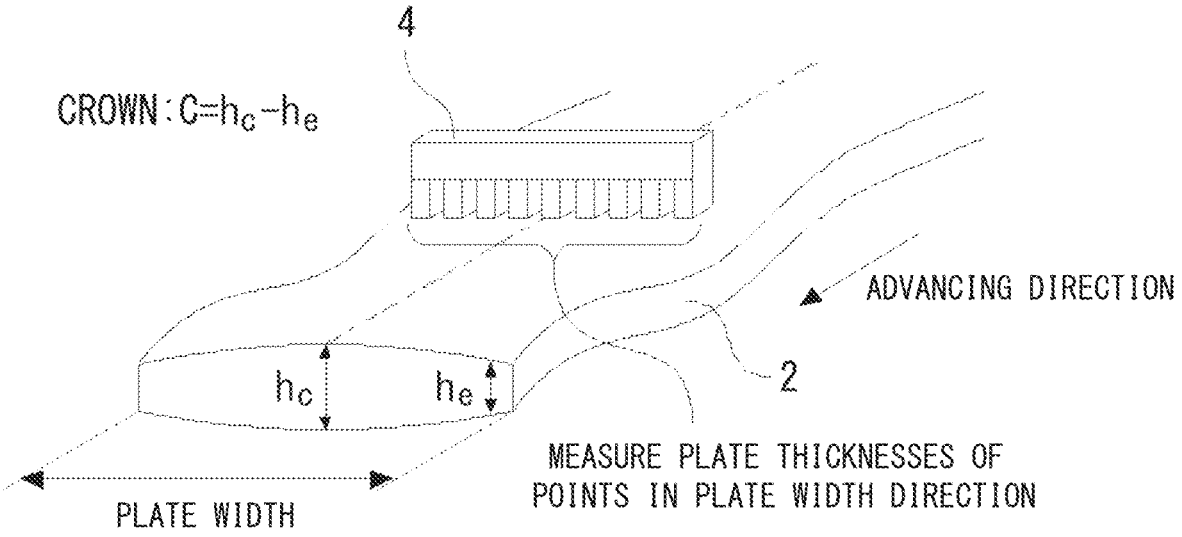
FIG. 2 is a diagram illustrating a definition of a plate crown and a configuration of a plate crown meter.

FIG. 2 is a diagram illustrating a definition of a plate crown and a configuration of the plate crown meter 4. As illustrated in FIG. 2, if a center plate thickness in a plate width direction of a rolling material is represented as $h_c$ and a plate thickness at a predetermined distance (as an example, 40 mm) from an edge portion is represented as $h_e$, the plate crown is defined as a deviation between the center plate thickness $h_c$ and the plate thickness $h_e$.

Rolling mills of the stands illustrated in FIG. 1 are roll shift type rolling mills in which upper and lower work rolls 6 are paired. The upper and lower work rolls 6 include predetermined crown curves for sectional shape control. The rolling mills include work roll shift mechanisms 7 and work roll bending mechanisms 8 for moving the upper and lower work rolls 6 in the axial direction.

A plate crown control device 10 is connected to the plate thickness meter 3, the plate crown meter 4, the flatness meter 5, the work roll shift mechanisms 7, the work roll bending mechanisms 8, and the like. The plate crown control device 10 determines shift amounts and bending forces of the stands in order to obtain a predetermined material to be rolled sectional shape.

Figure 3:
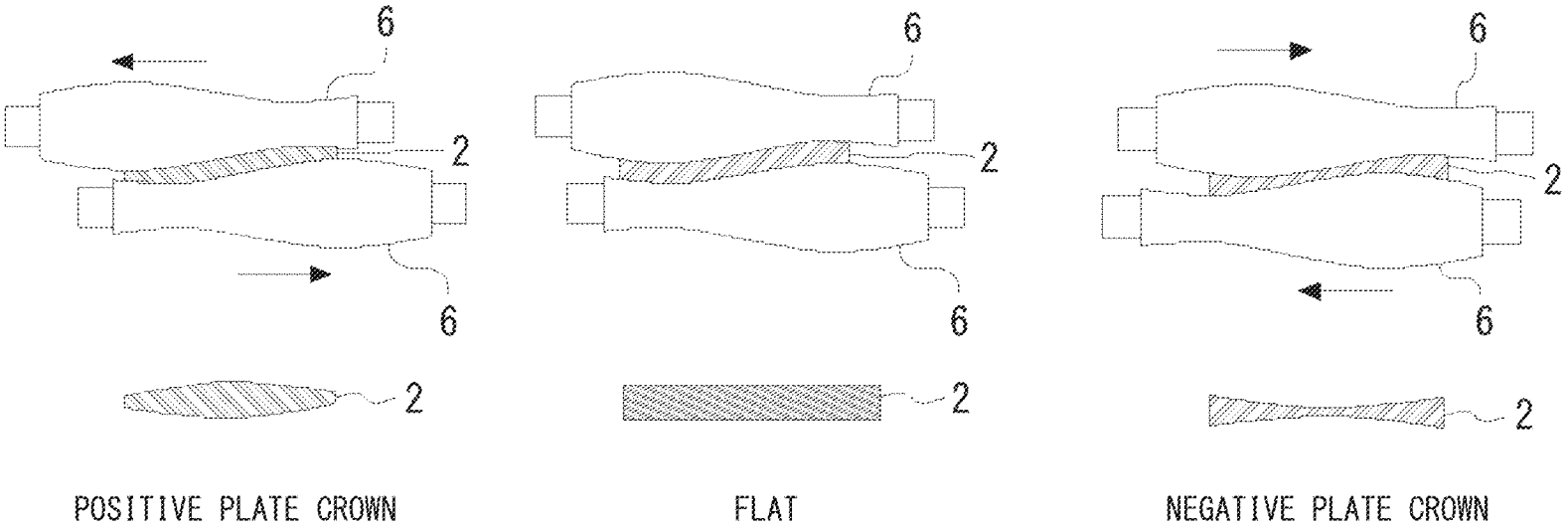
FIG. 3 is a diagram for explaining a work roll shift mechanism.

FIG. 3 is a diagram for explaining the work roll shift mechanism 7. The work rolls 6 are ground in a shape having unevenness represented by a third or higher order curve and are vertically disposed in opposite directions. The work roll shift mechanism 7 moves (shifts) the upper and lower work rolls 6 by the same distance in opposite directions each other in the axial direction to thereby change a distribution of roll gaps and change the plate crown of the material to be rolled. In FIG. 3, work roll shift states corresponding to three shift positions are illustrated. The work rolls 6 are called CVC (Continuous Variable Crown) rolls but are referred to as curve rolls herein. A moving distance in the axial direction of the work rolls 6 is referred to as shift amount. An average of the diameters of the upper and lower work rolls 6 in a certain position in the axial direction is referred to as average roll diameter. A difference between average roll diameters in a roll center and a roll end portion in a certain shift position is referred to as equivalent roll crown.

Figure 4:
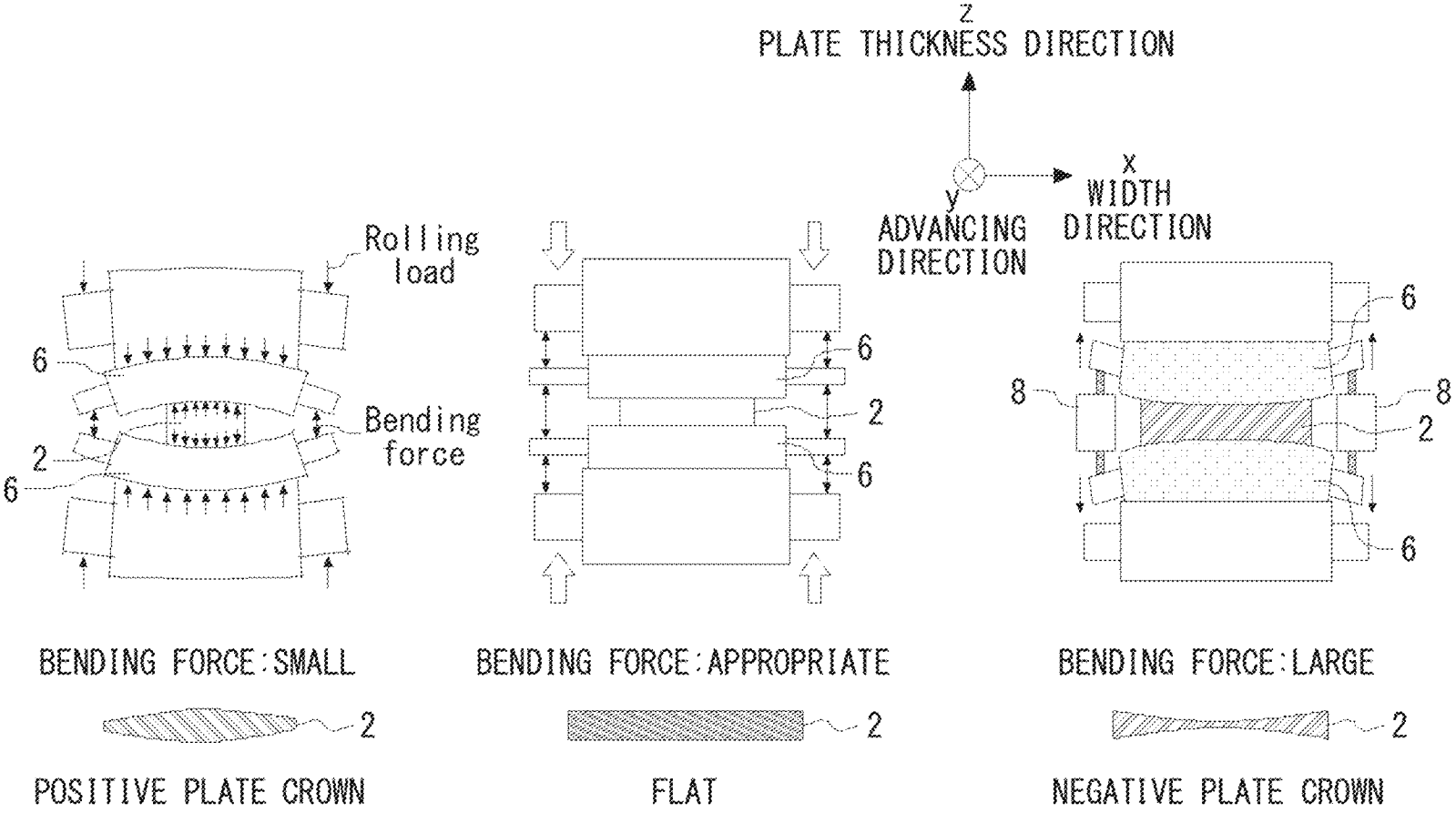
FIG. 4 is a diagram for explaining a work roll bending mechanism.

FIG. 4 is a diagram for explaining the work roll bending mechanisms 8. The work roll bending mechanisms 8 are mechanism that apply a bending force in the up-down direction to the shaft ends of the work rolls 6 to thereby bend the work rolls 6 and change a contact stress distribution of the work rolls 6 and the material to be rolled 2 to thereby change the plate crown of the material to be rolled 2. The bending force is generated by hydraulic cylinders provided between the upper and lower work rolls 6 and caused to act on the work rolls 6 via axle boxes attached to the work roll shaft ends and bearings of the shaft boxes. The hydraulic cylinders are present at both ends of the work rolls 6. A total of forces generated by both of the hydraulic cylinders is referred to as bending force. As illustrated in FIG. 4, when the bending force is increased, the plate crown decreases and, when the bending force is reduced, the plate crown increases. In general, when a roll force is increased, rolls bend and a plate crown increases.

Therefore, it is necessary to appropriately increase the bending force according to the increase in the roll force.

2. Plate Crown Control Device

Figure 5:
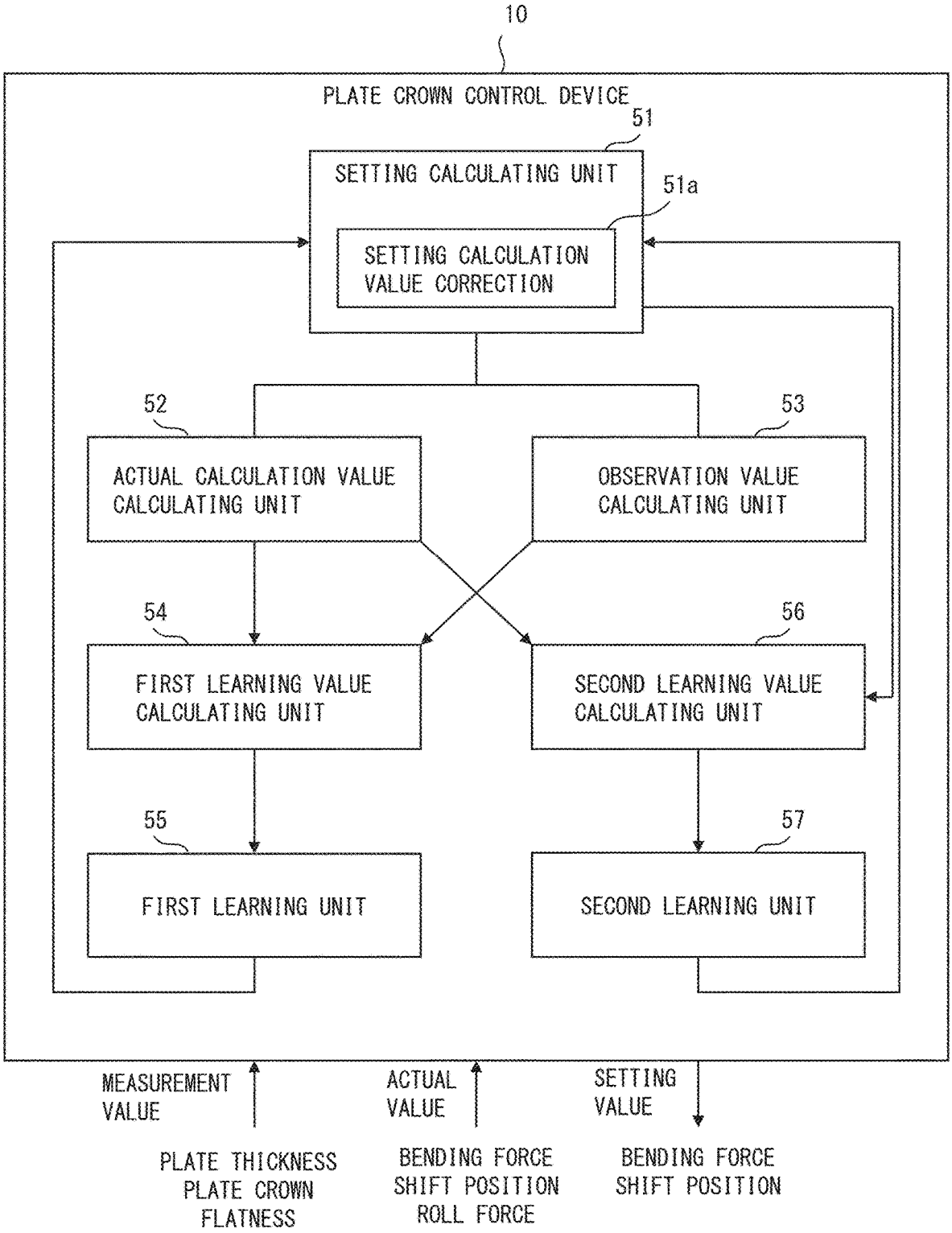
FIG. 5 is a block diagram illustrating an overview of functions included in a plate crown control device according to the embodiment of the present invention.

FIG. 5 is a block diagram illustrating an overview of functions included in the plate crown control device 10. The plate crown control device 10 includes a setting calculating unit 51, an actual calculation value calculating unit 52, an observation value calculating unit 53, a first learning value calculating unit 54, a first learning unit 55, a second learning value calculating unit 56, and a second learning unit 57.

2-1. Setting Calculating Unit

The setting calculating unit 51 performs setting calculation before the material to be rolled 2 bites into the finishing mill and calculates shift position setting values and bending force setting values of the upper and lower work rolls 6 of the stands such that a desired plate crown is obtained on a finisher delivery side and the material to be rolled flattens among the stands. In general, the setting calculation means performing numerical value calculation of a rolling phenomenon according to a mathematical model and determining a rolling schedule. Specifically, the setting calculation means calculating target dimensions and temperatures in steps from extraction of a slab (a base material) from a heating furnace to winding completion of a hot rolling coil (a product) and calculating initial setting of actuators (initial positions of a roll gap and a shift) for achieving the target dimensions and the temperatures.

The plate crown control device 10 operates the work roll shift mechanisms 7 and moves the shift positions of the work rolls 6 to the shift position setting values. Further, after the material to be rolled 2 is bit in, the plate crown control device 10 operates the work roll bending mechanisms 8 and causes the bending forces to coincide with the bending force setting values. In general, during the rolling, the shift positions of the stands are fixed from the viewpoint of machine protection.

Here, a method of calculating a setting value in the setting calculation is explained. It is known that a change in plate crowns on entry and delivery sides of the stands is represented by the following Expression (1). Plate crown prediction formulas on the entry and delivery sides of the stands indicated by Expression (1) are disclosed in, for example, PTL 2.

[Math. 1]

$$\frac{C_{hi}}{h_i} = \zeta_i \cdot \frac{C_{Mi}}{h_i} + \eta_i \cdot \frac{C_{HI}}{H_i} \tag{1}$$

Here, i represents a number of a stand and, for example, in the case of a seven-stand rolling mill, i is 1 to 7. Here, $H_i$ represents a plate thickness on the entry side of the stands and $h_i$ represents a plate thickness on the delivery side. $C_{Hi}$ represents a plate crown (an entry-side plate crown) of the material to be rolled 2 on the entry side. $C_{hi}$ represents a plate crown (a delivery-side plate crown) on the delivery side. $C_{Mi}$ represents a mechanical plate crown.

The mechanical plate crown is called roll gap crown as well and is a plate crown determined from elastic deformation of the rolling mill. The mechanical plate crown is a gap distribution, that is, a plate thickness distribution between the upper and lower work rolls 6 at the time when it is assumed that a width direction distribution of a roll force acting between the material to be rolled 2 and the work rolls 6 is uniform, the plat thickness distribution being represented by a difference between a plate thickness in a center position in the plate width direction and a plate thickness at a plate end, that is, a plate crown.

The mechanical plate crown is theoretically calculated by calculating elastic deformation of the rolling mill based on rolling conditions including a roll dimension and a roll crown of the rolling mill and a plate width, an entry-side plate thickness, a delivery-side plate thickness, a roll force, a shift position, and a bending force of the material to be rolled 2. For example, PTL 2 discloses an analytically obtained approximation formula. PTL 3 discloses a solution method for dividing a roll axial direction into a large number of small regions.

According to the approximation formula and the solution method, the mechanical plate crown is represented by the following Expression (2). Note that, since a diameter, length, a modulus of elasticity, a Poisson's ratio, and the like of rolls do not change, description thereof is omitted.

[Math. 2]

$$C_{Mi} = f(H_i, h_i, P_i, F_i, C_{wi}, C_{bi}) \quad (2)$$

Here, P represents a roll force, F represents a bending force, H represents an entry-side plate thickness, and h represents a delivery-side plate thickness. $C_w$ represents an equivalent roll crown of the work rolls 6. $C_b$ represents an equivalent roll crown of a backup roll. The equivalent roll crown is affected by thermal expansion and wear other than a shift position and is represented by a function as described below.

[Math. 3]

$$C_{wi} = f_w(L_{wrsi}, C_{thrmi}, c_{weari}) \quad (3A)$$

$$C_{bi} = f_b(C_{bthrmi}, c_{bweari}) \quad (3B)$$

Here, $L_{wrsi}$ represents a shift position of a curve roll. $C_{thrmi}$ represents a crown change due to work roll thermal expansion. $C_{weari}$ represents a crown change due to work roll wear. $C_{bthrmi}$ represents a crown change due to backup roll thermal expansion. $C_{bweari}$ represents a crown change due to backup roll wear.

(Plate Crown Ratio Heredity Coefficient)

Further, $\eta_i$ in Expression (1) indicates a plate crown ratio heredity coefficient.

Here, the plate crown ratio heredity coefficient means an influence coefficient applied to a plate crown ratio (a delivery-side plate crown radio) ($C_{hi}/h_i$) on the delivery side of the stands at the time when only a plate crown ratio (an entry-side plate crown ratio) ($C_{hi}/H_i$) on the entry side of the stands fluctuates while all the other rolling conditions remain the same.

It is known that the plate crown ratio heredity coefficient is represented as a function value having geometrical conditions such as a plate width/plate thickness ratio and a roll diameter as parameters (for example, PTL 2).

The delivery-side plate crown ratio is affected by the entry-side plate crown ratio in this way because of a mechanism in which the entry-side plate crown changes, whereby a slight difference occurs in a plate width direction distribution of extension in rolling in the relevant stand and, as a result, a width direction distribution of tension in a roll bite changes, a contact stress distribution of rolls and a material to be rolled changes, and elastic deformation of the rolls changes accordingly.

(Transfer Ratio)

Further, $\xi$ in Expression (1) indicates a transfer ratio.

Here, the transfer ratio means an influence coefficient applied to the plate crown ratio (the delivery-side plate crown ratio) ($C_{hi}/h_i$) on the stand delivery side at the time when only a value ($C_{Mi}/h_i$) obtained by dividing mechanical plate crowns of the stands by the relevant stand delivery-side plate thickness fluctuates while all the other rolling conditions remain the same.

When the entry-side plate crown ratio and the delivery-side plate crown ratio are not greatly different, it is known that the following relation is present between the plate crown ratio heredity coefficient and the transfer ratio (for example, PTL 2).

[Math. 4]

$$\zeta_i = 1 - \eta_i \quad (4)$$

(Flatness Limit)

On the delivery side of the stands, a difference occurs in strains in the longitudinal direction depending on a position in the width direction according to a change in a plate crown. If a plate crown ratio (a value obtained by dividing the plate crown by a plate thickness) on the stand entry side and a plate crown ratio on the stand delivery side are the same, a difference does not occur in strains and the material to be rolled 2 remains flat. Conversely, if the difference between the plate crown ratio on the stand entry side and the plate crown ratio on the stand delivery side exceeds an allowable value (referred to as flatness limit), the material to be rolled buckles and a flatness failure such as waving or middle waviness occurs.

The flatness limit has been experimentally examined. For example, the following Expression (5) is known (NPL 3).

[Math. 5]

$$-80\cdot\left(\frac{h_i}{B_i}\right)^2 < \frac{C_{Hi}}{H_i} - \frac{C_{hi}}{h_i} < 40\cdot\left(\frac{h_i}{B_i}\right)^2 \quad (5)$$

Here, $B_i$ represents a stand delivery-side plate width. In thin plate hot rolling, substantially the same result is obtained even if a value obtained by converting a product width into a thermal dimension (a dimension considering thermal expansion) is used.

A plate crown ratio on a first stand entry side of the finishing mill is determined by a condition on a roughing mill side and is different from a target plate crown ratio on a last stand delivery side of the finishing mill. Therefore, it is necessary to change plate crown ratios in several stands of the finishing mill and cause the delivery-side plate crown of the last stand to coincide with the target plate crown. Accordingly, from Expression (5), a plate crown ratio is mainly changed in a pre-stage side stand where the flatness limit is large and a plate crown ratio change is reduced in a post-stage side stand.

(Control Based on Setting Calculation)

In the setting calculation, the delivery-side plate crown $C_{hi}$ of the stands is calculated from such a viewpoint, the delivery-side plate crown $C_{hi}$ is substituted in Expression (1) to calculate the mechanical plate crowns $C_{Mi}$ of the stands, and the mechanical plate crowns $C_{Mi}$ are further substituted in Expression (2) and Expression (3) to inversely solve the expressions, whereby a bending force and a shift position are determined.

Note that there is priority in operation of the bending force and the shift position. First, the shift position is operated in a state in which the bending force is set to any value and, when the shift position reaches a mechanical or operational movable limit, the shift position is fixed to the movable limit and the bending force is operated.

However, when a large number of materials to be rolled 2 are continuously rolled, since thermal expansion and wear of the work rolls 6 develop, it is difficult to satisfactorily maintain the accuracy of the setting calculation.

Therefore, in this embodiment, after starting finish rolling, the plate crown control device 10 samples, for a measurement point set in the longitudinal direction of the material to be rolled 2, a delivery-side plate crown measurement value and a flatness measurement value of the last stand measured by a plate crown meter 4 and a flatness meter 5 and actual values including roll forces, bending forces, and shift positions at the times when the measurement point passed the stands. The plate crown control device 10 learns a correction amount (a learning value) for the setting calculation based on the measurement values and the actual values and corrects a setting calculation value with the learned correction value in setting calculation for the next material to be rolled (the next material). With such learning, it is possible to improve the accuracy of the setting calculation for the next and subsequent materials. It is possible to improve plate crown accuracy of the material to be rolled.

A learning method of the present invention is explained below.

2-2. Actual Calculation Value Calculating Unit

First, the actual calculation value calculating unit 52 calculates mechanical plate crown actual calculation values of the stands.

An actual calculation value is a value calculated by giving, as a parameter, an actual value collected during rolling to the same model formula as the model formula used in the setting calculation. In the following explanation, the actual calculation value is distinguished by adding a suffix ACAL. A mechanical plate crown actual calculation value is calculated as follows according to Expression (2) and Expression (3).

[Math. 6]

$$C_{Mi}^{ACAL} = f\left(H_i, h_i, P_i^{ACT}, F_i^{ACT}, C_{wi}^{ACAL}, C_{bi}^{ACAL}\right) \tag{6}$$

$$C_{wi}^{ACAL} = f_w\left(L_{wrsi}^{ACT}, C_{thrmi}^{ACAL}, C_{weari}^{ACAL}\right) \tag{7}$$

$$C_{bi}^{ACAL} = f_b\left(C_{bthrmi}^{ACAL}, C_{bweari}^{ACAL}\right) \tag{8}$$

Here, $P_i^{ACT}$ represents a roll force measurement value. $F_i^{ACT}$ represents a bending force measurement value. $L_{wrsi}^{ACT}$ represents a shift position actual value. $C_{thrmi}^{ACAL}$ represents a roll crown change amount by thermal expansion of the work rolls 6. $C_{weari}^{ACAL}$ represents a roll crown change amount by wear of the work rolls 6. $C_{bthrmi}^{ACAL}$ represents a roll crown change amount by thermal expansion of the backup roll. $C_{bweari}^{ACAL}$ represents a roll crown change amount by wear of the backup roll.

When these are substituted in Expression (1) and sequentially calculated from an upstream side stand to a downstream side stand, delivery-side plate crown actual calculation values of the stands are obtained.

[Math. 7]

$$\frac{C_{hi}^{ACAL}}{h_i} = \zeta_i \cdot \frac{C_{Mi}^{ACAL}}{h_i} + \eta_i \cdot \frac{C_{Hi}^{ACAL}}{H_i} \tag{9}$$

In this way, the actual calculation value calculating unit 52 calculates, based on the measurement values and the actual values explained above, a mechanical plate crown actual calculation value $C_{Mi}^{ACAL}$ of the stands and a delivery-side crown actual calculation value $C_{hi}^{ACAL}$ of the stands.

2-3. Observation Value Calculating Unit

The observation value calculating unit 53 calculates, using first learning weight coefficients of the stands, mechanical plate crown observation values of the stands to coincide with a delivery-side plate crown measurement value of the last stand. An observation value is a value obtained by estimating, starting from a first stand entry-side plate crown $C_{H1}^{SUP}$ (a setting calculation value (a setup value) before a rolling start), a delivery-side mechanical plate crown $C_{Mi}$, a delivery-side plate crown $C_{hi}$, and the like of the stands excluding the last stand such that a delivery-side plate crown of the last stand coincides with a measurement value. In the following explanation, the observation value is distinguished by adding a suffix OBS.

There are a plurality of ideas for the estimation of an observation value $C_{Mi}^{OBS}$. Two calculation methods are explained below.

2-3-1. First Calculation Method for an Observation Value

A first calculation method for an observation value is a method based on an idea for, because, in the setting calculation, after the constraint conditions explained above are considered, delivery-side plate crowns of the stands are calculated such that the flatness among the stands is within the flatness limit, maintaining a distribution of delivery-side crowns of the stands as much as possible.

Therefore, a plate crown error measured on the last stand delivery side is distributed to the stands using a plate thickness ratio and a learning weight coefficient. As indicated by the following Expression (10), the observation value calculating unit 53 multiplies a deviation between a delivery-side plate crown measurement value $C_{hN}^{ACT}$ of the last stand and a delivery-side plate crown actual calculation value $C_{hN}^{ACAL}$ of the last stand by a first learning weight coefficient $w_i$ of the stands and a plate thickness ratio (hi/Hi), adds a delivery-side plate crown actual measurement value $C_{hi}^{ACAL}$ of the stands, and calculates a delivery-side plate crown observation value $C_{hi}^{OBS}$ of the stands.

[Math. 8]

$$C_{hi}^{OBS} = C_{hi}^{ACAL} + \frac{w_i}{w_{TOTAL}} \cdot \frac{h_i}{h_N} \cdot \left(C_{hN}^{ACT} - C_{hN}^{ACAL}\right) \tag{10}$$

$$w_{TOTAL} = \sum_{i=1}^{N} w_i \tag{11}$$

Note that the first learning weight coefficient $w_i$ is a learning weight coefficient for adjusting a distribution ratio of a plate crown ratio error measured on the last stand delivery side to learning values of the stands. A method of determining $w_i$ is explained below.

When Expression (1) is transformed and an entry-side plate crown observation value $C_{Hi}^{OBS}$ ($=C_{hi-1}^{OBS}$) of the stands, the delivery-side plate crown observation value $C_{hi}^{OBS}$ of the stands, and the mechanical plate crown observation value $C_{Mi}^{OBS}$ of the stands are substituted in Expression (10), the following Expression (12) is obtained.

[Math. 9]

$$C_{Mi}^{OBS} = \frac{1}{\zeta_i} \cdot C_{hi}^{OBS} - \frac{\eta_i}{\zeta_i} \cdot \frac{h_i}{H_i} \cdot C_{Hi}^{OBS} \tag{12}$$

As indicated by Expression (12), the observation value calculating unit 53 calculates the mechanical plate crown observation value $C_{Mi}^{OBS}$ of the stands using the entry-side plate crown observation value $C_{Hi}^{OBS}$ of the stands and the delivery-side plate crown observation value $C_{hi}^{OBS}$ of the stands, heredity coefficients $\eta_i$, transfer ratios $\xi_i$, and the ratio ($h_i/H_i$) of the plate thicknesses on the entry side and the delivery side of the stands.

2-3-2. Second Calculation Method for an Observation Value

A second calculation method for an observation value is a method based on an idea for, because, in the setting calculation, after the constraint conditions explained above are considered, an optimum combination of delivery-side plate crowns and mechanical plate crows of the stands is calculated, maintaining a distribution of the delivery-side plate crowns and the mechanical plate crowns as much as possible.

In this calculation method, in calculating the mechanical plate crown observation value $C_{Mi}^{OBS}$ of the stands and the delivery-side plate crown observation value $C_{hi}^{OBS}$ of the stands excluding the last stand, the observation value calculating unit 53 sets constraint conditions, design variables, and an objective function as explained below and calculates the design variables to minimize the objective function.

Figure 6:
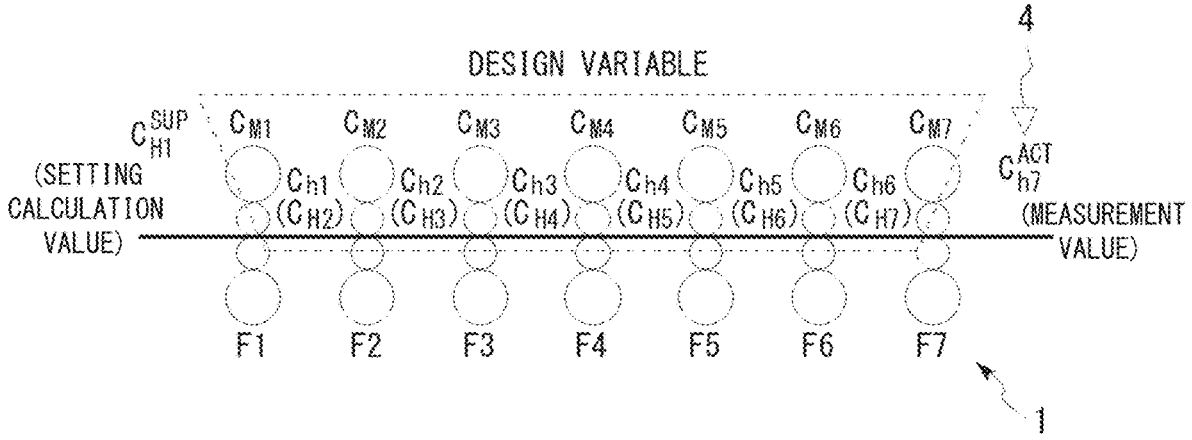
FIG. 6 is a diagram illustrating an example of a design variable.

The constraint conditions are plate crown prediction formulas on entry and delivery sides of the stands (i=1, . . . , N) described in Expression (1). The observation value $C_{hi}^{OBS}$ is substituted in the plate crowns among the stands in Expression (1) and the observation value $C_{Mi}^{OBS}$ is substituted in the mechanical plate crowns of the stands. Expression (13A) is a constraint condition in the case of the first stand, Expression (13B) is a constraint condition in the case of a stand that is neither the first stand nor the last stand, and Expression (13C) is a constraint condition in the case of the last stand. As illustrated in FIG. 6, the mechanical plate crown observation value $C_{Mi}^{OBS}$ of the stands and the delivery-side plate crown observation value $C_{hi}^{OBS}$ of the stands excluding the last stand are set as design variables. That is, the number of design variables is (N×2−1), where N is the number of stands. Note that a setting calculation value $C_{H1}^{SUP}$ is used for an entry-side plate crown of the first stand and a measurement value $C_{hN}^{ACT}$ is used for an delivery-side plate crown of the last stand.

[Math. 10]

$$\frac{C_{hi}^{OBS}}{h_i} = \zeta_i \cdot \frac{C_{Mi}^{OBS}}{h_i} + \eta_i \cdot \frac{C_{H1}^{SUP}}{H_1} \tag{13A}$$

$$\frac{C_{hi}^{OBS}}{h_i} = \zeta_i \cdot \frac{C_{Mi}^{OBS}}{h_i} + \eta_i \cdot \frac{C_{hi-1}^{OBS}}{h_{i-1}} \tag{13B}$$

$$\frac{C_{hi}^{ACT}}{h_i} = \zeta_i \cdot \frac{C_{Mi}^{OBS}}{h_i} + \eta_i \cdot \frac{C_{hi-1}^{OBS}}{h_{i-1}} \tag{13C}$$

Figure 7:
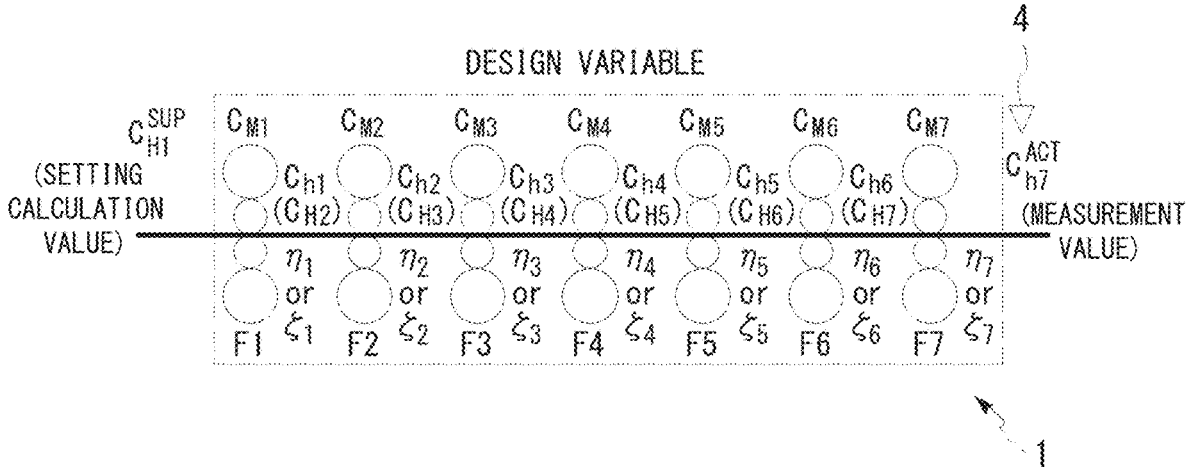
FIG. 7 is a diagram illustrating an example of a design variable.

When the crown ratio heredity coefficients $\eta_i$ or the transfer ratios $\xi_i$ of the stands are included in the design variables as illustrated in FIG. 7 in addition to the plate crowns and the mechanical plate crowns of the stands, an inequality of Expression (13D) or Expression (13E) is added to the constraint conditions. Expression (13D) indicates that the plate crown ratio heredity coefficients $\eta_i$ are larger in the post-stage stand than the pre-stage stand. Expression (13E) indicates that the transfer ratios $\xi_i$ are smaller in the post-stage stand than the pre-stage stand.

[Math. 11]

$$\eta_i < \eta_{i+1} \ (i = 1, \ldots, N-1) \tag{13D}$$

$$\zeta_{i+1} < \zeta_i \ (i = 1, \ldots, N-1) \tag{13E}$$

Figure 8:
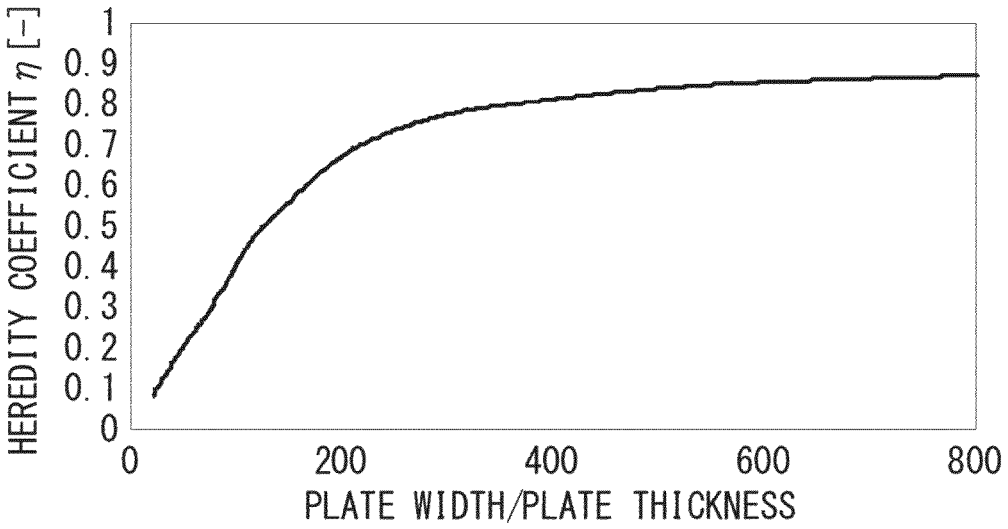
FIG. 8 is a graph illustrating a relation between an aspect ratio (plate width/plate thickness) and a crown ratio heredity coefficient.

This is because, as illustrated in FIG. 8, it is known that the crown ratio heredity coefficient $\eta_i$ is a function value having the horizontal axis as an aspect ratio (plate width/plate thickness) and increases toward the post-stage stand having a smaller plate thickness.

An objective function Φ is Expression (14) or Expression (15) described below. That is, a total of absolute values or a square sum of a deviation between the mechanical plate crown observation value $C_{Mi}^{OBS}$ of the stands and the mechanical plate crown actual calculation value $C_{Mi}^{ACAL}$ of the stands or values obtained by multiplying the deviation by the first learning weight coefficient $w_i$ of the stands is set as the objective function.

[Math. 12]

$$\Phi = \sum_{i=1}^{N} \left| \frac{C_{Mi}^{OBS} - C_{Mi}^{ACAL}}{w_i} \right| \tag{14}$$

$$\Phi = \sum_{i=1}^{N} \left( \frac{C_{Mi}^{OBS} - C_{Mi}^{ACAL}}{w_i} \right)^2 \tag{15}$$

Note that the first learning weight coefficient $w_i$ is a learning weight coefficient for adjusting a distribution ratio of a plate crown ratio error measured on the last stand delivery side to learning values of the stands and may be set to any value or may be calculated by a determination method explained below.

The observation value calculating unit 53 calculates the design variables to minimize the objective function Φ. Consequently, the mechanical plate crown observation value $C_{Mi}^{OBS}$ of the stands is obtained. Since Expressions (13A) to (13C) are linear formulas of the observation value $C_{Mi}^{OBS}$, a linear programming method such as a Simplex method can be used for this calculation when the objective function is Expression (11). When the objective function is Expression (12), a quadratic programming method can be used. According to Expression (11), a calculation load is low and calculation can be performed in a short time. On the other hand, according to Expression (12), it is sometimes possible to calculate a more appropriate distribution of the mechanical plate crown observation value $C_{Mi}^{OBS}$ to the stands.

2-4. First Learning Value Calculating Unit and First Learning Unit

Using the mechanical plate crown observation value $C_{Mi}^{OBS}$ of the stands obtained by the first calculation method (2-3-1) or the second calculation method (2-3-2) for the observation value explained above, the first learning value calculating unit 54 calculates a first learning current value $Z_{MOi}^{CUR}$ (Current value: CUR) of the stands based on the difference between the mechanical plate crown observation value $C_{Mi}^{OBS}$ of the stands and the mechanical plate crown actual calculation value $C_{Mi}^{ACAL}$ of the stands.

[Math. 13]

$$Z_{MO_i}^{CUR} = C_{Mi}^{OBS} - C_{Mi}^{ACAL} \tag{16}$$

The first learning unit 55 reads a first learning value $Z_{MOi}^{OLD}$ (OLD values) of the stands stored in a learning table (steel type×plate thickness×plate width) and updates the first learning value $Z_{MOi}^{OLD}$ as indicated by the following Expression (17) using the first learning current value $Z_{MOi}^{CUR}$ of the stands. A new first learning value $Z_{MOi}^{NEW}$ (NEW values) is written back to the learning table.

[Math. 14]

$$Z_{MOi}^{NEW} = \alpha_{MOi} \cdot Z_{MOi}^{CUR} + (1 - \alpha_{MOi}) \cdot Z_{MOi}^{OLD} \tag{17}$$

Here, $\alpha_{MOi}$ represents a smoothing gain ($0 \leq \alpha_{MOi} \leq 1$) adjustable for each of the stands.

A first learning value $Z_{MOi}$ mainly includes correction amounts for an estimated error of a mechanical plate crown change due to a roll force and a bending force, estimated errors of roll thermal expansion and wear, and the like.

2-5. Method of Determining a First Learning Weight Coefficient

In obtaining the mechanical plate crown observation value $C_{Mi}^{OBS}$ of the stands according to the first calculation method (2-3-1) or the second calculation method (2-3-2) for the observation value explained above, there are different determination methods explained below for the first learning weight coefficient $w_i$ for adjusting distribution of a plate crown ratio error measured in the last stand to first learning values of the stands.

A first determination method is a determination method for setting the first learning weight coefficient $w_i$ of all the stands (i=1, . . . , N) to the same value (for example, $w_i$=1.0). According to this determination method, since distribution of the plate crown ratio error measured in the last stand to stand learning values is nearly equal, there is a characteristic that changes in a bending force and a shift position due to learning are easily understood for an operator and, therefore, intervention operation is also easily performed.

A second determination method is a determination method for setting the first learning weight coefficient $w_i$ larger as a variable range of delivery-side plate crown ratios of the stands is larger. Upper limit values and lower limit values are provided for bending forces and shift positions of the stands because of mechanical specifications and operational reasons. When the upper limit values and the lower limit values are substituted in Expression (2) and Expression (3), an upper limit value $C_{Mi}^{MAX}$ and a lower limit value $C_{Mi}^{MIN}$ of a mechanical plate crown are obtained. When the upper and lower limit values are respectively substituted in Expression (1), a difference between the upper and lower limit values (a mechanical plate crown variable range) is calculated, and the difference is multiplied by a transfer ratio and divided by the relevant stand delivery-side plate thickness, Expression (18) of a first plate crown ratio variable range $\Delta\gamma_{hi}^{CHG1}$ is obtained.

[Math. 15]

$$\Delta\gamma_{hi}^{CHG1} = \zeta_i \cdot \frac{C_{Mi}^{MAX} - C_{Mi}^{MIN}}{h_i} \tag{18}$$

On the other hand, since a maximum value and a minimum value of a crown ratio change within a flatness limit are obtained by Expression (5), when a difference between the maximum value and the minimum value is calculated, Expression (19) of a variable range $\Delta\gamma_{hi}^{CHG2}$ of a second plate crown ratio is obtained.

[Math. 16]

$$\Delta\gamma_i^{CHG2} = \varepsilon_i^{MAX} - \varepsilon_i^{MIN} \tag{19}$$

A plate crown ratio variable range of the smaller of Expression (18) and Expression (19) is adopted and a variable range of delivery-side plate crown ratios of the stands is obtained. As the variable range of the delivery-side plate crown ratios of the stands is larger, the learning weight coefficient $w_i$ is determined larger. The plate crown ratio variable range is preliminarily calculated under typical operation conditions. The first learning weight coefficient $w_i$ can be determined with reference to the plate crown ratio variable ranges.

If the first learning weight coefficient $w_i$ is determined by calculation as indicated by the following Expression (20), a more appropriate value is obtained. The observation value calculating unit 53 multiplies the smaller of the first plate crown ratio variable range $\Delta\gamma_{hi}^{CHG1}$ and the second plate crown ratio variable range $\Delta\gamma_{hi}^{CHG2}$ by a correction coefficient $k_i$ to calculate the first learning weight coefficient $w_i$ of the stands.

[Math. 17]

$$w_i = k_i \cdot \min\left(\Delta\gamma_i^{CHG1}, \Delta\gamma_i^{CHG2}\right) + c_i \tag{20}$$

Here, correction coefficients $k_i$ and $c_i$ for each of the stands are any constants. Usually, $k_i$ is the same value for all the stands and $c_i$ is zero. However, $k_i$ and $c_i$ are sometimes finely adjusted according to an operation state.

Note that the first learning weight coefficient $w_i$ is normalized by $w_{TOTAL}$ and used as indicated by Expression (10) and Expression (11).

According to this determination method, a plate crown ratio error measured in the last stand is distributed to stand learning values according to plate crown ratio variable ranges of the stands. Therefore, there is a characteristic that problems in that, for example, a plate crown ratio variable range of any one of the stands has no margin, a shift position and a bending force of the stand reach upper and lower limit values, and flatness on the stand delivery side is deteriorated less easily occur.

2-6. Second Learning Value Calculating Unit and Second Learning Unit

Subsequently, second learning is explained. In the second learning, the difference between the delivery-side plate crown actual calculation value $C_{hN}^{ACAL}$ and the setting calculation value $C_{hN}^{SUP}$ of the last stand is distributed as stand delivery-side plate crown errors using a plate thickness ratio ($h_i/h_N$) and a second learning weight coefficient $u_i$. A mechanical plate crown correction amount necessary to correct the stand delivery-side plate crown errors is represented by the following Expression (21A) using a transfer ratio. This is a second learning current value (a Current value: CUR) for a mechanical plate crown setting value.

[Math. 18]

$$Z_{MA_i}^{CUR} = \frac{1}{\zeta_i} \cdot \frac{u_i}{u_{TOTAL}} \cdot \left(C_{hN}^{ACAL} - C_{hN}^{SUP}\right) \cdot \frac{h_i}{h_N} \tag{21A}$$

$$u_{TOTAL} = \sum_{i=1}^{N} u_i \tag{21B}$$

As indicated by Expression (21A), the second learning value calculating unit 56 calculates a second learning current value $Z_{MAi}^{CUR}$ of the stands using the difference between the delivery-side plate crown actual calculation value $C_{hN}^{ACA}L$ of the last stand and the delivery-side plate crown setting calculation value $C_{hN}^{SUP}$ of the last stand, the second learning weight coefficient $u_i$ of the stands, and the transfer ratio $\xi_i$ of the stands.

Note that the second learning weigh coefficient $u_i$ is a learning weight coefficient for adjusting, in second learning, a distribution ratio of the difference between the delivery-side plate crown actual calculation value $C_{hN}^{ACAL}$ and the setting calculation value $C_{hN}^{SUP}$ of the last stand to learning values of the stands. A method of determining $u_i$ is explained below.

The second learning unit 57 reads a second learning value $Z_{MAi}^{OLD}$ (OLD values) of the stands stored in the learning table (steel type×plate thickness×plate width) and updates the second learning current value $Z_{MAi}^{CUR}$ of the stands as indicated by the following Expression (22). A new second learning value $Z_{MAi}^{NEW}$ (NEW values) is written back to the learning table.

[Math. 19]

$$Z_{MAi}^{NEW} = \alpha_{MAi} \cdot Z_{MAi}^{CUR} + (1 - \alpha_{MAi}) \cdot Z_{MAi}^{OLD} \tag{22}$$

Here, $\alpha_{MAi}$ represents a smoothing gain ($0 \leq \alpha_{MAi} \leq 1$) adjustable for each of the stands.

The second learning value $Z_{MAi}$ includes differences in shift positions and bending forces during setting calculation and during learning and mainly includes a correction amount by manual intervention of the operator. It is highly likely that the operator is performing the manual intervention after visually checking states of the stands. Therefore, it is inappropriate to distribute the second learning value $Z_{MAi}$ to the other stands as well. It is appropriate to mainly distribute the second learning value $Z_{MAi}$ to a learning value of the stand.

Therefore, the second learning weight coefficient $u_i$ of the stands is suitably determined by the following Expression (23) based on the difference between the actual calculation value $C_{Mi}^{ACAL}$ and the setting calculation value $C_{Mi}^{SUP}$ of mechanical plate crowns of the stands.

[Math. 20]

$$u_i = \frac{C_{Mi}^{ACAL} - C_{Mi}^{SUP}}{h_i} \tag{23}$$

That is, the second learning weight coefficient $u_i$ of an i-th stand is a value obtained by dividing the difference between the mechanical plate crown actual calculation value $C_{Mi}^{ACAL}$ of the i-th stand and the mechanical plate crown setting calculation value $C_{Mi}^{SUP}$ of the i-th stand by a delivery-side plate thickness $h_i$ of the i-th stand. Consequently, a value of $u_i$ is greatly distributed to a place where the difference between an actual calculation value and a setting calculation value is large.

2-7. Setting Calculating Unit (Setting Calculation in the Next and Subsequent Materials)

Subsequently, correction in setting calculation in the next and subsequent materials is explained. As indicated by Expression (24), the setting calculating unit 51 executes, in setting calculation for the next and subsequent materials, setting calculation value correction 51*a* for calculating mechanical plate crown setting calculation values after correction of the stands obtained by adding the first learning value $Z_{MOi}^{NEW}$ of the stands and the second learning value $Z_{MAi}^{NEW}$ of the stands read from the learning table to the mechanical plate crown setting calculation value $C_{Mi}^{SUP}$ of the stands.

[Math. 21]

$$C_{Mi} = f(H_i, h_i, P_i, F_i, C_{wi}, C_{bi}) + Z_{MOi} + Z_{MAi} \tag{24}$$

Consequently, mechanical plate crown setting calculation values of the stands are corrected based on a learning result. By substituting the mechanical plate crown setting calculation values in Expression (2) and Expression (3) and inversely solving the expressions, setting values of a bending force and a shift position are corrected and a finisher delivery-side plate crown can be brought close to a target value.

3. Effects

As explained above, with the plate crown control device 10 according to this embodiment, it is possible to estimate, based on a measurement value measured by the plate crown meter 4 disposed on the last stand delivery side, a mechanical plate crown observation value according to a crown variable range, a quadratic programming method, or the like and learn a difference between the mechanical plate crown observation value and a mechanical plate actual calculation value. A mechanical plate crown prediction value (a setting calculation value) can be corrected in setting calculation for the next and subsequent materials using a result of the learning (a first learning value).

Consequently, it is possible to suppress occurrence of a problem in that flatness on the delivery side of the stands is deteriorated and a problem in that bending forces and shift positions of the stands reach mechanical and operational limit values and a target plate crown cannot be achieved. As a result, it is possible to improve setting accuracy of work roll bending, curve roll shift, and the like, bring a last stand delivery-side plate crown close to a target value, and realize stable plate leaping and improvement of a yield.

With the plate crown control device 10 according to this embodiment, as indicated by Expression (20), it is possible to perform learning of plate crown models of the stands to be able to secure a margin considering both of mechanical plate crown variable ranges and shape dead zones of the stands. Therefore, an advantage is obtained that an upper limit or a lower limit of a mechanical crown is less easily reached and it is highly likely to be able to cause flatness among the stands and the last stand delivery-side crown to coincide with target values.

With the plate crown control device 10 according to this embodiment, it is possible to learn a difference between a delivery-side plate crown actual calculation value and a delivery-side plate crown setting calculation value of the last stand (a second learning value). Consequently, it is also possible to learn correctio results of a bending force and a shift position by the operator.

4. Modifications

Incidentally, in the embodiment explained above, when the manual intervention of the operator is less, it is possible to omit the second learning value $Z_{MAi}$ of the difference between the actual calculation value and the setting calculation value and the calculation of the second learning value $Z_{MAi}$. Note that the first learning value $Z_{MOi}$ and the calculation of the first learning value $Z_{MOi}$ can also be omitted.

When a plate crown meter is set on a delivery side of a stand other than the last stand, the present invention can be applied by replacing the last stand with a plate thickness meter installation stand and replacing the stands with stands that are further upstream than the plate thickness meter.

When the plate crown control device 10 other than the work roll shift mechanisms 7 such as a pair cross device, a VC roll device, or an intermediate roll shift device of a six-stage rolling mill is used, the present invention can be applied by replacing the shift position with an operation amount of an actuator of the device.

In the case of a reversing mill that performs rolling a plurality of times (paths) while changing a rolling direction with one stand, the present invention can be applied by replacing the stand with a pass.

5. Hardware Configuration Example

Figure 9:
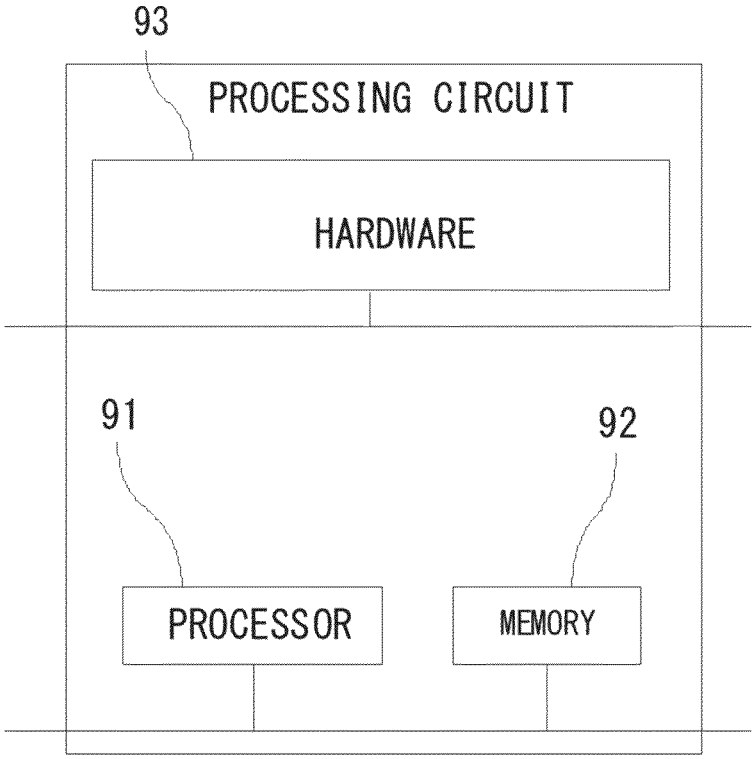
FIG. 9 is a block diagram illustrating a hardware configuration example of the plate crown control device according to the embodiment of the present invention.

FIG. 9 is a conceptual diagram illustrating a hardware configuration example of a processing circuit included in the plate crown control device 10 in the embodiment explained above. Functions of the plate crown control device 10 are realized by the processing circuit. As an aspect, the processing circuit includes at least one processor 91 and at least one memory 92. As another aspect, the processing circuit includes at least one dedicated hardware 93.

When the processing circuit includes the processor 91 and the memory 92, the functions are realized by software, firmware, or a combination of the software and the firmware. At least one of the software and the firmware is described as a program. At least one of the software and the firmware is stored in the memory 92. The processor 91 realizes the functions by reading and executing the program and various data stored in the memory 92. The various data stored in the memory 92 include measurement values measured by the plate crown meter 4 and the flatness meter 5 explained above. The various data include actual values such as roll forces, bending forces, and shift positions of the stands. The various data include a learning table that stores first learning values and second learning values of the stands.

When the processing circuit includes the dedicated hardware 93, the processing circuit is, for example, a single circuit, a composite circuit, a programmed processor, or a combination of the foregoing. The functions are realized by the processing circuit.

The embodiment of the present invention is explained above. However, the present invention is not limited to the embodiment explained above and can be variously modified and implemented without departing from the gist of the present invention. When numbers such as the numbers, quantities, amounts, and ranges of the elements are referred to in the embodiment explained above, the present invention is not limited by the numbers referred to except when being particularly clearly indicated or when being clearly specified to the numbers in principle. The structures and the like explained in the embodiment explained above are not always essential to the present invention except when being particularly clearly indicated or when being clearly specified to the structures and the like in principle.

REFERENCE SIGNS LIST

1 Rolling equipment
2 Material to be rolled
3 Plate thickness meter
4 Plate crown meter
5 Flatness meter
6 Work roll
7 Work roll shift mechanism
8 Work roll bending mechanism
10 Plate crown control device
51 Setting calculating unit
51*a* Setting calculation value correction
52 Actual calculation value calculating unit
53 Observation value calculating unit
54 First learning value calculating unit
55 First learning unit
56 Second learning value calculating unit
57 Second learning unit
91 Processor
92 Memory
93 Hardware

The invention claimed is:

1. A plate crown control device that controls tandem rolling equipment, which continuously rolls a material to be rolled with a plurality of stands, based on delivery-side plate crown setting calculation values of the stands calculated by setting calculation, mechanical plate crown setting calculation values of the stands, and setting values of bending forces and shift positions of the stands, comprising:

at least one processor; and at least one memory, wherein the at least one memory stores:

a delivery-side plate crown measurement value measured, for a measurement point set in a longitudinal direction of the material to be rolled, by a plate crown meter installed on a delivery side of a last stand among the stands;

actual values including roll forces, bending forces, and shift positions at a time when the measurement point passes the stands; and a learning table that stores first learning values of the stands, wherein the at least one processor is configured by execution of computer readable instructions stored in the at least one memory to execute:

actual calculation value calculation for calculating mechanical plate crown actual calculation values of the stands based on plate thickness of the material to be rolled on an entry side of the stands, plate thickness of the material to be rolled on a delivery side of the stands, and the actual values;

observation value calculation for calculating, using first learning weight coefficients of the stands, mechanical plate crown observation values of the stands to coincide with the delivery-side plate crown measurement value of the last stand;

first learning value calculation for calculating first learning current values of the stands based on differences between the mechanical plate crown observation values of the stands and the mechanical plate crown actual calculation values of the stands;

first learning for prorating, with the first learning current values and smoothing gains of the stands, the first learning values of the stands stored in the learning table and updating the first learning values; and setting calculation value correction for calculating, in the setting calculation for a next and subsequent materials, the setting values of bending forces and shift positions of the stands using a corrected set of mechanical plate crown setting calculation values after correction of the stands obtained by adding the first learning values of the stands read from the learning table to the mechanical plate crown setting calculation values of the stands, wherein the learning table stores second learning values of the stands, wherein the actual calculation value calculation includes calculating delivery-side plate crown actual calculation values of the stands based on the measurement values and the actual values, wherein the at least one processor is further configured to execute:

second learning value calculation for calculating second learning current values of the stands using a difference between the delivery-side plate crown actual calculation value of the last stand and the delivery-side plate crown setting calculation value of the last stand, second learning weight coefficients of the stands, and transfer ratios of the stands; and second learning for prorating, with the second learning current values and the smoothing gains of the stands, the second learning values of the stands stored in the learning table and updating the second learning values, wherein the setting calculation value correction calculates, in the setting calculation for the next and subsequent materials, the setting values of bending forces and shift positions of the stands using a corrected set of mechanical plate crown calculation values after correction of the stands obtained by adding the first learning values of the stands and the second learning values of the stands read from the learning table to the mechanical plate crown setting calculation values of the stands.

2. The plate crown control device according to claim 1, wherein actual calculation value calculation includes calculating delivery-side plate crown actual calculation values of the stands based on the mechanical plate crown actual calculation values of the stands, wherein the observation value calculation is configured to:

multiply a deviation between the delivery-side plate crown measurement value of the last stand and the delivery-side plate crown actual calculation value of the last stand by the first learning weight coefficients and plate thickness ratios of the stands, adds the delivery-side plate crown actual calculation values of the stands, and calculates delivery-side plate crown observation values of the stands; and calculate the mechanical plate crown observation values of the stands using entry-side plate crown observation values of the stands and the delivery-side plate crown observation values of the stands, heredity coefficients, transfer ratios, and ratios of plate thickness on the entry side and the delivery side of the stands.

3. The plate crown control device according to claim 1, wherein the second learning weight coefficients of the stands are values obtained by dividing differences between the mechanical plate crown actual calculation values of the stands and the mechanical plate crown setting calculation values of the stands by delivery-side plate thicknesses of the stands.

4. A plate crown control device that controls tandem rolling equipment, which continuously rolls a material to be rolled with a plurality of stands, based on delivery-side plate crown setting calculation values of the stands calculated by setting calculation, mechanical plate crown setting calculation values of the stands, and setting values of bending forces and shift positions of the stands, comprising:

at least one processor; and at least one memory, wherein the at least one memory stores:

a delivery-side plate crown measurement value measured, for a measurement point set in a longitudinal direction of the material to be rolled, by a plate crown meter installed on a delivery side of a last stand among the stands;

actual values including roll forces, bending forces, and shift positions at a time when the measurement point passes the stands; and a learning table that stores first learning values of the stands, wherein the at least one processor is configured by execution of computer readable instructions stored in the at least one memory to execute:

actual calculation value calculation for calculating mechanical plate crown actual calculation values of the stands based on plate thickness of the material to be rolled on an entry side of the stands, plate thickness of the material to be rolled on a delivery side of the stands, and the actual values;

observation value calculation for calculating, using first learning weight coefficients of the stands, mechanical plate crown observation values of the stands to coincide with the delivery-side plate crown measurement value of the last stand;

first learning value calculation for calculating first learning current values of the stands based on differences between the mechanical plate crown observation values of the stands and the mechanical plate crown actual calculation values of the stands;

first learning for prorating, with the first learning current values and smoothing gains of the stands, the first learning values of the stands stored in the learning table and updating the first learning values; and setting calculation value correction for calculating, in the setting calculation for a next and subsequent materials, the setting values of bending forces and shift positions of the stands using a corrected set of mechanical plate crown setting calculation values after correction of the stands obtained by adding the first learning values of the stands read from the learning table to the mechanical plate crown setting calculation values of the stands, wherein the observation value calculation is configured to:

set plate crown prediction formulas of the stands as constraint conditions;

set the mechanical plate crown observation values of the stands and delivery-side plate crown observation values of the stands excluding the last stand as design variables;

set a total or a square sum of deviations between the mechanical plate crown observation values of the stands and the mechanical plate crown actual calculation values of the stands or absolute values of values obtained by multiplying the deviations by the first learning weight coefficients of the stands as an objective function; and calculate the design variables to minimize the objective function.

5. The plate crown control device according to claim 4, wherein the design variables include plate crown ratio heredity coefficients or transfer ratios of the stands, wherein the constraint conditions include an inequality indicating that the plate crown ratio heredity coefficients are larger in a post-stage stand than a pre-stage stand or the transfer ratios are smaller in the post-stage stand than the pre-stage stand.

6. A plate crown control device that controls tandem rolling equipment, which continuously rolls a material to be rolled with a plurality of stands, based on delivery-side plate crown setting calculation values of the stands calculated by setting calculation, mechanical plate crown setting calculation values of the stands, and setting values of bending forces and shift positions of the stands, comprising:

at least one processor; and at least one memory, wherein the at least one memory stores:

a delivery-side plate crown measurement value measured, for a measurement point set in a longitudinal direction of the material to be rolled, by a plate crown meter installed on a delivery side of a last stand among the stands;

actual values including roll forces, bending forces, and shift positions at a time when the measurement point passes the stands; and a learning table that stores first learning values of the stands, wherein the at least one processor is configured by execution of computer readable instructions stored in the at least one memory to execute:

actual calculation value calculation for calculating mechanical plate crown actual calculation values of the stands based on plate thickness of the material to be rolled on an entry side of the stands, plate thickness of the material to be rolled on a delivery side of the stands, and the actual values;

observation value calculation for calculating, using first learning weight coefficients of the stands, mechanical plate crown observation values of the stands to coincide with the delivery-side plate crown measurement value of the last stand;

first learning value calculation for calculating first learning current values of the stands based on differences between the mechanical plate crown observation values of the stands and the mechanical plate crown actual calculation values of the stands;

first learning for prorating, with the first learning current values and smoothing gains of the stands, the first learning values of the stands stored in the learning table and updating the first learning values; and setting calculation value correction for calculating, in the setting calculation for a next and subsequent materials, the setting values of bending forces and shift positions of the stands using a corrected set of mechanical plate crown setting calculation values after correction of the stands obtained by adding the first learning values of the stands read from the learning table to the mechanical plate crown setting calculation values of the stands, wherein, in the observation value calculation, the at least one processor is further configured to:

calculate mechanical plate crown variable ranges of the stands from upper limit values and lower limit values of bending forces and shift positions of the stands;

multiply the mechanical plate crown variable ranges of the stands by transfer ratios and divides the multiplied mechanical plate crown variable ranges by stand delivery-side plate thicknesses to calculate first plate crown ratio variable ranges of the stands;

calculate second plate crown ratio variable ranges of the stands based on flatness limits of the stands; and determine the first learning weight coefficient of the stands so that the larger the variable range of delivery-side plate crown ratios of the stands obtained by the smaller of the first plate crown ratio variable ranges and the second plate crown ratio variable ranges, the larger the learning weight coefficient.

* * * * *